US007823402B2

(12) United States Patent
Hayashida et al.

(10) Patent No.: US 7,823,402 B2
(45) Date of Patent: Nov. 2, 2010

(54) AIR-CONDITIONER UNIT AND METHOD OF CONVEYING THE SAME

(75) Inventors: Katsuhiko Hayashida, Tokyo (JP); Keisuke Hokazono, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 218 days.

(21) Appl. No.: 11/579,333

(22) PCT Filed: Oct. 4, 2005

(86) PCT No.: PCT/JP2005/018318

§ 371 (c)(1),
(2), (4) Date: Nov. 1, 2006

(87) PCT Pub. No.: WO2007/043132

PCT Pub. Date: Apr. 19, 2007

(65) Prior Publication Data

US 2008/0250806 A1 Oct. 16, 2008

(51) Int. Cl.
*F25D 23/12* (2006.01)

(52) U.S. Cl. ..... 62/259.1; 62/508

(58) Field of Classification Search ..... 62/259.1, 62/503, 507, 508

See application file for complete search history.

(56) References Cited

U.S. PATENT DOCUMENTS 4,723,419 A 2/1988 Kessler et al.
5,619,863 A * 4/1997 Kil ..... 62/428
5,775,120 A 7/1998 Inazuka et al.
2005/0204767 A1 9/2005 Norrell et al.

FOREIGN PATENT DOCUMENTS

EP 0 738 651 A2 10/1996
EP 1 403 590 3/2004
JP 06-281206 (A) 10/1994

(Continued)

OTHER PUBLICATIONS

Supplementary European Search Report issued in corresponding Application No. 05790500.2-1266 dated Jul. 28, 2009.

(Continued)

*Primary Examiner*—Melvin Jones
(74) *Attorney, Agent, or Firm*—Buchanan Ingersoll & Rooney PC

(57) ABSTRACT

A housing capable of being carried into an elevator cage and turned with ease even in the elevator cage having a narrow frontage is provided. A housing 1 is configured to have a dimension A of a first face narrower than an effective doorway dimension a of an elevator cage 20, and a dimension B of a second face wider than an effective depth b of the elevator cage 20, and corner portions are chamfered in an up and down direction, and the chamfered dimension X is set to a value obtained by subtracting the effective depth b of the elevator cage 20 from the dimension B of the second face. Further, the corner portions may be chamfered in a same shape. In addition, each of the corner portions is chamfered to have an angle of approximately 45 degrees in relation to an adjoining surface.

7 Claims, 5 Drawing Sheets

A: DEPTH OF HOUSING
B: WIDTH OF HOUSING
X: LENGTH OF CHAMFERED PORTION (CHAMFERED DIMENSION)

FOREIGN PATENT DOCUMENTS

| | | | |
|---|---|---|---|
| JP | 08-035690 | A | 2/1996 |
| JP | 08-282984 | A | 10/1996 |
| JP | 09-133382 | A | 5/1997 |
| JP | 11-237083 | A | 8/1999 |
| JP | 2003-254565 | A | 9/2003 |
| WO | WO 99/28681 | | 6/1999 |

OTHER PUBLICATIONS

Chinese Office Action dated Jul. 25, 2008 (with translation) in connection with the corresponding Chinese Application No. 200580017361.6.

Chinese Office Action dated May 8, 2009 (refer to translation of Jan. 29, 2010 Chinese Office Action) in connection with the corresponding Chinese Application No. 200580017361.6.

Chinese Office Action dated Jan. 29, 2010 (with translation) in connection with the corresponding Chinese Application No. 200580017361.6.

Japanese Office Action dated May 26, 2010.

* cited by examiner

A: DEPTH OF HOUSING
B: WIDTH OF HOUSING
X: LENGTH OF CHAMFERED PORTION (CHAMFERED DIMENSION)

20: ELEVATOR
a: EFFECTIVE DOORWAY DIMENSION OF ELEVATOR
b: EFFECTIVE DEPTH OF ELEVATOR

AIR-CONDITIONER UNIT AND METHOD OF CONVEYING THE SAME

TECHNICAL FIELD

The present invention relates to a housing capable of being conveyed, such as, for example, an outdoor unit of an air conditioner, utilizing an elevator cage, and a method of conveying the housing.

BACKGROUND ART

For example, in a case that an outdoor unit of an air conditioner is installed on a rooftop of a building, the outdoor unit is conveyed to the roof top utilizing an existing elevator cage that is previously installed in the building. However, in a case of an outdoor unit having a rectangular plane shape, when the outdoor unit is conveyed by being carried into the elevator cage, an end face side of the outdoor unit is restricted by a dimension of a doorway of the elevator cage, and a rear face side of the outdoor unit is restricted by a depth dimension of the elevator cage. Accordingly, so as to accommodate an outdoor unit, in which a certain dimension or more is preferably ensured for its shorter face side and the longer face side, in an ordinary elevator cage having narrow dimensions of a frontage and a depth, the outdoor unit is tried to be accommodated in the elevator cage by means of inserting the shorter face side of the outdoor unit into the elevator cage through the doorway, and then turning the same in the elevator cage. However, in many cases, since a corner portion of the outdoor unit is caught by an internal wall of the elevator cage, the outdoor unit cannot be turned and thereby the outdoor unit cannot be loaded in the elevator cage after all. Consequently, the outdoor unit has to be conveyed by hoisting the same from the rooftop using a crane or the like. As a result, the crane itself has to be arranged and thereby a large-scale conveying work is required resulting in enormous conveying cost and a long delivery period.

Therefore, a technique for conveying the outdoor unit, in which a dimension of the outdoor unit is reduced to a dimension smaller than that of the frontage of the elevator cage by dismantling the parts provided on a side face of the outdoor unit at a time of conveyance, so that the outdoor unit can be conveyed even in an elevator cage having a narrow frontage, is disclosed (refer to, for example, the Patent Document 1).

Paten Document Japanese Unexamined Patent Application Publication No. 08-35690 (See page 2 through 4, and FIG. 4)

DISCLOSURE OF INVENTION

Problems to be Solved by the Invention

According to the technique described in the Patent Document 1, the parts provided on a side face of the outdoor unit have to be dismantled when the outdoor unit of an air conditioner is carried into an elevator cage having a narrow frontage, and therefore much work is required every time when carrying into the elevator cage.

The present invention is made in light of solving the above-described problems and it is an object of the present invention to provide a housing capable of easily being carried even into an elevator cage having a narrow frontage, and a method of conveying the same.

Means for Solving the Problems

A housing of the present invention is a housing having a dimension of a first face narrower than an effective doorway dimension of an elevator cage, and a dimension of a second face wider than an effective depth of the elevator cage, and the housing is accommodated within the elevator cage while turning the same by means of chamfering a corner portion of the housing in an up and down direction. The chamfering dimension is set to a value obtained by subtracting a depth dimension of the elevator cage from the dimension of the second face of the housing.

Advantages

Since a housing can be carried into an elevator cage using existing facilities, saving of labor at a time of conveyance can be increased and a conveying cost can be reduced. Further, a delivery period for installation can be reduced.

BEST MODE FOR CARRYING OUT THE INVENTION

First Embodiment

Figure 1:
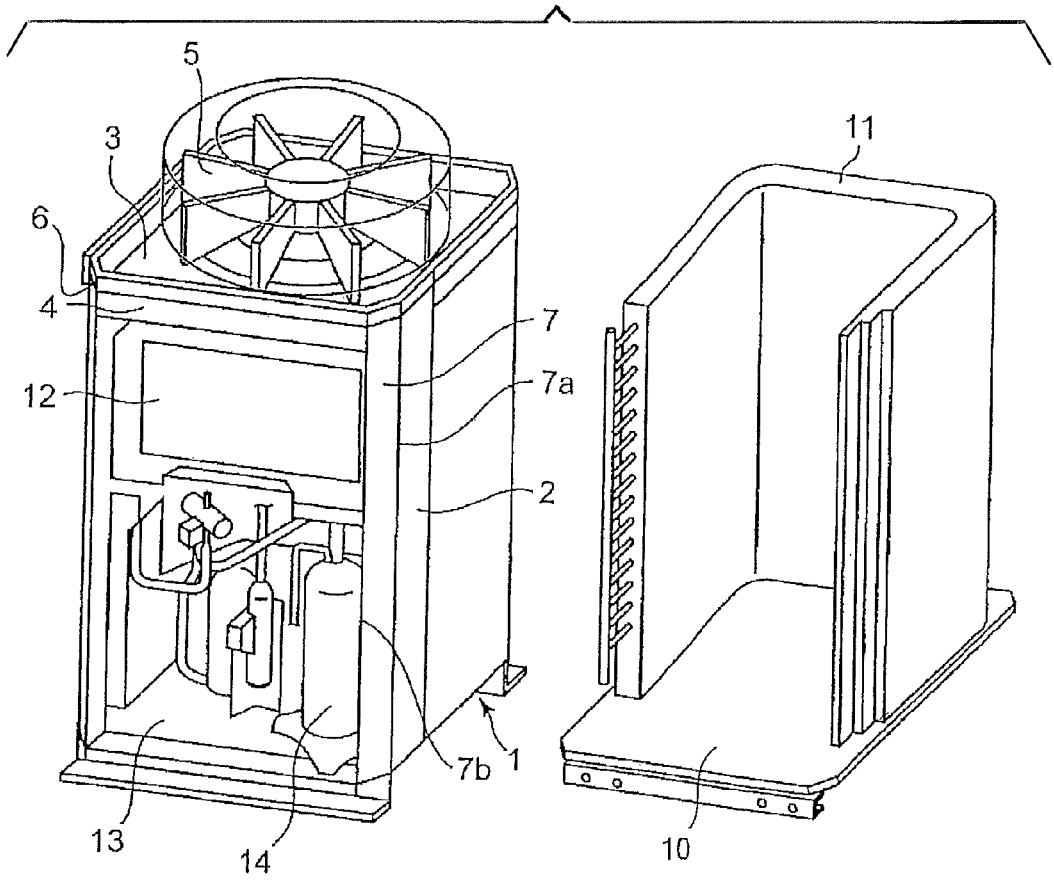
FIG. 1 is a perspective view illustrating an exploded condition of an outdoor unit of an air conditioner, according to a first embodiment of the present invention.
Figure 2:
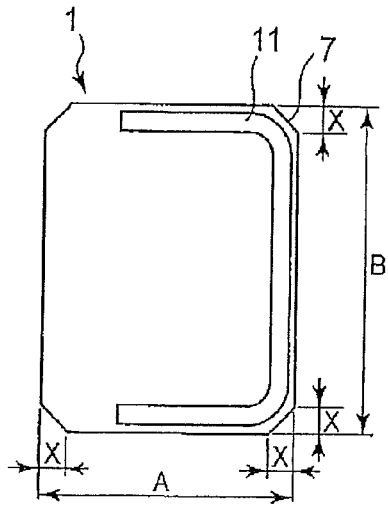
FIG. 2 is a cross-sectional plan view illustrating the outdoor unit, according to the first embodiment.
Figure 3:
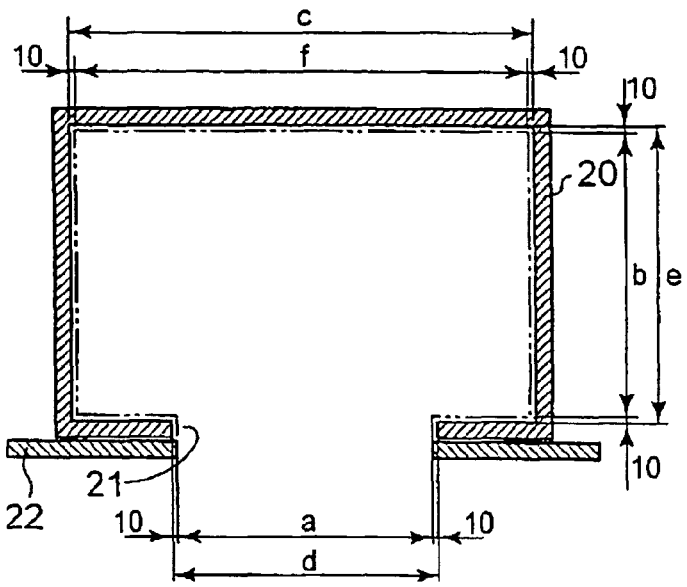
FIG. 3 is a cross-sectional plan view illustrating an elevator cage, according to the first embodiment.

FIG. 1 is a perspective view illustrating an exploded condition of an outdoor unit of an air conditioner, which is an example of a housing according to the present invention, FIG. 2 is a cross-sectional plan view illustrating a main part of an assembled condition of FIG. 1, and FIG. 3 is a cross-sectional plan view illustrating an elevator cage.

As illustrated in FIG. 1, the outdoor unit of the air conditioner is constituted by approximately rectangular solid-shaped housing 1, and standing columns 2 are provided at four corners of the housing 1, and an upper face 3 and an upper face frame 4 are provided at an upper part of the standing columns 2. In addition, a fan 5 is attached to the upper face 3, and a resin made fan cover 6 is attached in a manner so as to cover the fan 5 and the upper face frame 4.

A heat exchanger unit having approximately U-shaped cross-section, whose corner portion is formed of a curved shape, which is provided in a standing manner on a bottom face 10 is installed in an inner part of the housing 1. (Hereinafter, an opening portion side of the U-shaped heat exchanger unit is referred to as a front face, a side opposite to the opening portion is referred to as a rear face, and each of sides corresponding to both arms is referred to as a side face.) Further, a control box 12 is provided at an upper part of the housing 1, and a machine room 13 is provided at a lower part thereof in a manner so as to be surrounded by the heat exchanger unit 11, and a compressor 14 and the like are disposed in the machine room 13.

Incidentally, since the fan cover 6 covers an outside of the upper face frame 4, and prevents the outdoor unit from getting bruised at the time when the outdoor unit is turned in the elevator cage, the fan cover 6 actually constitutes the maximum dimension of an outer periphery of the outdoor unit. Further, the fan cover 6 is a molded product of resin material, and is configured for both an internal wall of the elevator cage and the outdoor unit not to be damaged, even at the time when the latter collides with the former.

In each of the standing columns 2 of the housing 1, a chamfered portion 7 where the corner portion of the standing column 2 is cut out in the same shape in an up and down direction of the standing column 2 is provided, and the chamfered portion 7 is chamfered to form an angle of approximately 45 degrees in relation to an adjoining surface of the housing 1, namely, is chamfered to have a cross-section of approximately a right-angled triangle shape. Further, the outdoor unit is configured not to interfere with the internal wall of the elevator cage by means of the chamfered portion 7 when being turned to be accommodated within the elevator cage.

As illustrated in FIGS. 2 and 3, the dimension of the shorter face side of the outdoor unit (for example, the depth A from a front face side of the housing 1 to a rear face side) is approximately the same as an effective dimension a of the doorway (described later) in a width direction of an elevator cage 20, and the dimension of the longer face side (for example, a width B between the side faces of the outdoor unit) is approximately equal to b+X, in which b is defined by an effective depth of the elevator cage 20 (described later) and X is defined by a dimension of the chamfered portion 7. Further, the dimension X of the chamfered portion can be changed within an area that does not interfere with the bent R of the heat exchanger unit 11. Furthermore, although the shorter face side of the outdoor unit is defined as the depth and the longer face side of the same is defined as width in the explanation described above, the shorter face side of the outdoor unit may be defined as width, and the longer face side may be defined as depth.

The elevator cage 20 has a doorway 21 at the front face thereof, and the doorway is configured to open and close in a left and right direction by means of a door 22. An internal dimension of the elevator cage 20 is defined as c for the width, e for the depth, and d for the doorway. Usually, in a case that large sized devices and equipment are conveyed by the elevator basket 20, the internal wall of the elevator cage 20 is guarded by concrete panels, or the like, so as not to be bruised. However, when a guarding thickness of the elevator cage 20 for conveyance is calculated, for example, 10 mm, in this case, and in consideration of this guarding thickness, effective dimension a of the doorway of the elevator cage 20 is found to be a value obtained by subtracting 10 (mm) times 2 from the dimension d of the doorway, and an effective depth b of the elevator cage 20 is found to be a value obtained by subtracting 10 (mm) times 2 from the depth e of the elevator cage 20. In other words, the depth A of the outdoor unit equals the effective dimension a of the elevator cage 20, and the side-face width B of the outdoor unit equals a sum of the effective depth b of the elevator cage 20 plus the dimensions X of the chamfered portions 7.

Incidentally, as described above, since the fan cover 6 of the outdoor unit constitutes the maximum dimension of the outer periphery of the outdoor unit, the dimension of the depth A and width B of the outdoor unit is determined on the basis of the dimension of the depth and width of the fan cover 6.

In the aforementioned elevator cage 20, the elevator for general passenger use with a capacity of six passengers (P6CO) regulated by JISA4301 has the minimum size in Japan (in this case, each of the internal dimensions of the elevator cage 20 is 1400 mm in width c, 850 mm in depth e, and 800 mm in dimension d of the doorway, respectively). In such an elevator cage 20, an outdoor unit having a width wider than the effective depth b of the elevator cage 20 is brought to be rotatable in the elevator cage 20, by chamfering the corner part of the outdoor unit, and workers can convey the outdoor unit while riding the elevator cage 20 together.

At this moment, it is natural that a limit in the height direction should be discussed, however, the outdoor unit described in the present embodiment has a sufficiently allowable height dimension and therefor the present embodiment does not describe the limit in the height direction. However, since the height of the doorway is set down to be 2000 mm at the minimum in the aforementioned Japanese Industrial Standard, this dimension is a rough standard in the height direction.

That is, in a case that the outdoor unit is conveyed by the aforementioned elevator cage 20 (JISA4301), since the dimension d of the doorway of the elevator cage 20 is set to 800 mm, the effective dimension a of the doorway is obtained to be 780 mm, which is d minus 10 (mm) times 2, and since the depth e of the elevator cage 20 is set to 850 mm, the effective depth b is obtained to be 830 mm, which is e minus 10 (mm) times 2. In this case, even when the side-face width B of the outdoor unit equals 830+X mm, the outdoor unit can be accommodated in the elevator cage 20 by turning it when the depth A of the outdoor unit equals 780 mm. That is, in general, since the outdoor unit is protruded from the elevator cage 20, the outdoor unit cannot be accommodated in the elevator cage 20. However, the outdoor unit is accommodated while being turned, by means of chamfering. This plane dimension is a dimension value in which an outdoor unit of a 10-horsepower class air conditioner, which has the most number of installations can be manufactured, and the outdoor unit can be conveyed by the elevator cage 20.

The following formula shows a relationship between a plane area of the outdoor unit defined as M ($m^2$) and the depth of the unit defined as A (mm), the effective depth of the elevator cage 20 defined as b (mm), and the chamfered dimension defined as X (mm).

$$M=A\times(b+X)-(X^2/2)\times 4$$

At this moment, A×(b+X) indicates the square part and $(X^2/2)\times 4$ indicates the cut out part of the corner portion. Accordingly, $$M = -2X^2 + AX + Ab$$
$$= -2(X - A/4)^2 + Ab + A^2/8$$

At this moment, the width B of the unit is expressed by B=b+X.

Accordingly, when the X=A/4, i.e., X become ¼ times depth dimension A of the unit, the plane area M reaches maximum as indicated by $Ab+A^2/8$.

Figure 4:
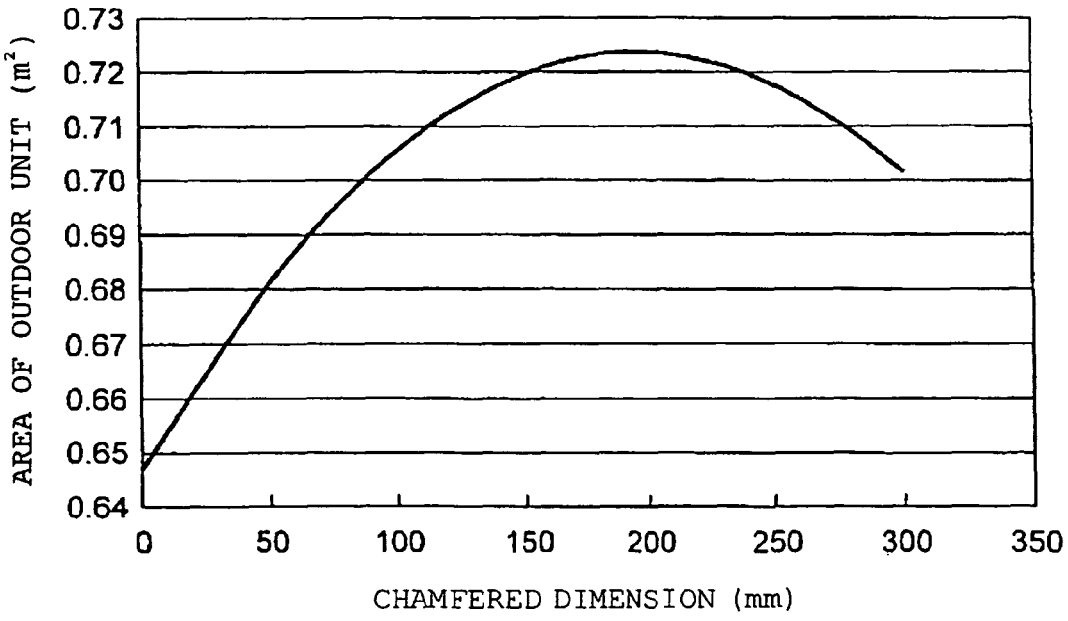
FIG. 4 is a diagrammatic drawing illustrating a relationship between a chamfering dimension of the outdoor unit and an area of the outdoor unit, according to the first embodiment.

In the minimum sized elevator cage 20 according the standard, JISA4301, when the dimension b is set to 830 mm and the dimension A becomes 780 mm at the maximum, the relationship between the dimension X (mm) of the chamfered portion of the outdoor unit and the plane area M ($mm^2$) of the outdoor unit is expressed by a diagrammatic drawing in FIG. 4. As illustrated in the figure, when the chamfered dimension X is set to 195 mm, the plane area of the outdoor unit can be increased by 12% compared to the case that the chamfered portion is not provided, and thereby a heat exchanger unit 11 and a refrigerant circuit parts having high capabilities can be mounted. In other words, when the width of the outdoor unit is set to 1025 mm and the chamfered dimension is set to 195 mm, the plane area reaches 0.7234 $m^2$, as the maximum value.

The above-described is a theoretically calculated value that is made without adding a structure in the internal portion of the housing. As described earlier, it is a premise that the corner chamfered dimension X does not interfere with the bent R of the heat exchanger unit, and a clearance of 30 mm between each of the standing columns 2 attached to the corner portions and the heat exchanger unit 11 is required as a space for inserting hands when the outdoor unit is carried into the elevator cage.

Figure 5:
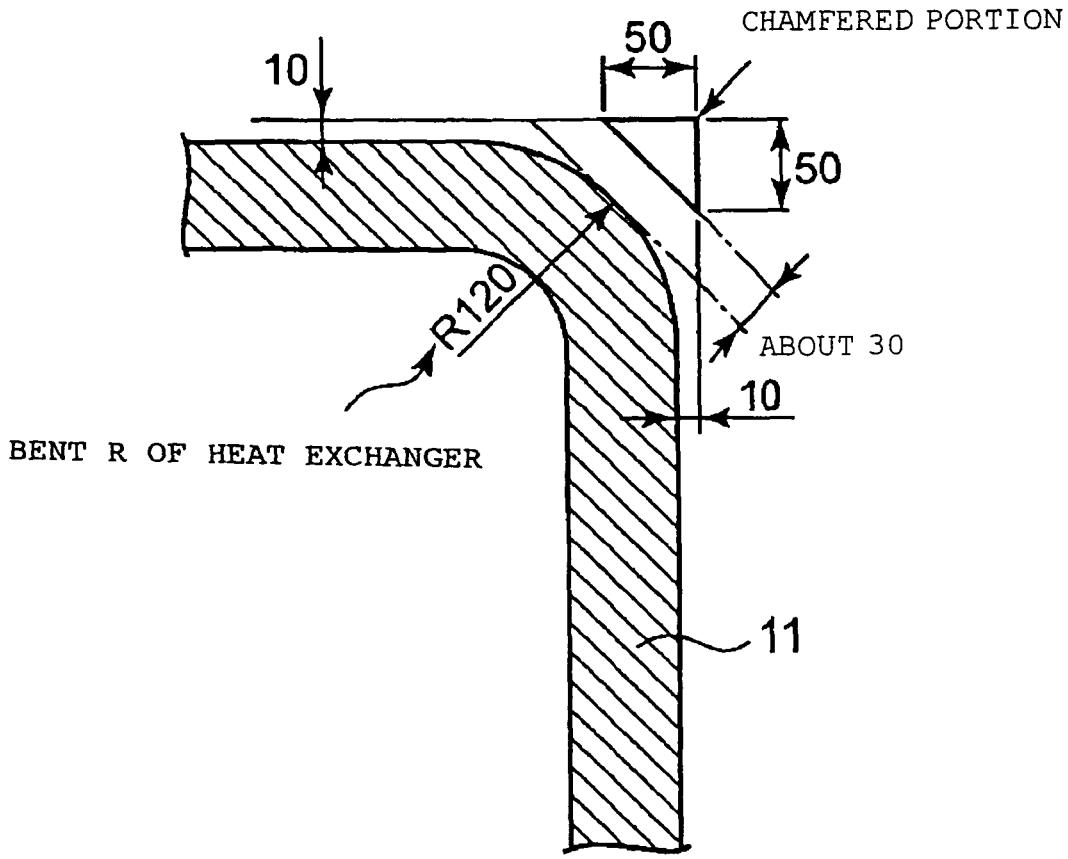
FIG. 5 is an explanatory view illustrating a relationship between a corner chamfering dimension of a heat exchanger unit and a bent of the heat exchanger unit, according to the first embodiment.

Further, in the case where the bent R of the heat exchanger unit 11 in FIG. 5 is increased, the chamfered dimension X can be increased and the plane area of the outdoor unit can be enlarged until 195 mm. However, in a case where the bent R is increased, the area of the heat exchanger unit 11 itself is decreased and thereby a required area cannot be obtained. Accordingly, the bendig work for the heat exchanger 11 is preferably performed to form a bent R as smaller as possible. Other than the above, in consideration of the clearance betwee the heating exchanger unit 11 and the standing columns 2, an appropriate chamfered dimension X for the heat exchanger unit of the present embodiment is 50 mm.

Namely, when the chamfered dimension X is set to 195 mm, this value results in the maximum plane area. Therefore, the above-described value is one of objectives when designing a large sized device and facilities.

However, in a case of the air conditioner, a design of the heat exchanger unit or an arrangement of parts of the refrigerant circuit is naturally restricted, and further the design of appearance has to be also considered. Further, in consideration of conveying workability, the chamfered dimension X is preferably not less than 50 mm. Furthermore, in consideration of the workers riding together, the side-face width B of the outdoor unit is preferably not more than 1000 mm.

According to the reason described above, following numeric values are considered as the dimensions of the air conditioner. That is, the side-face width exceeds 830 mm and is about 1000 mm (in a case that the conveying workers do not ride, the width can be set to not less than 1000 mm), the depth is not more than 780 mm, the chamfer is about 50 mm (however, when the capability of the heat exchanger unit is sufficient, a greater numeric value is more preferable.), and the height is not more than 2000 mm. In other words, so as to obtain an effective and a maximum plane area of the outdoor unit under condition of certain dimensions of the elevator cage 20, it is effective to set the dimension values, such that the dimension of the shorter face side is closer to the dimension of the doorway of the elevator basket 20, and the dimension of the longer face side exceeds the depth of the elevator cage 20.

Figure 6:
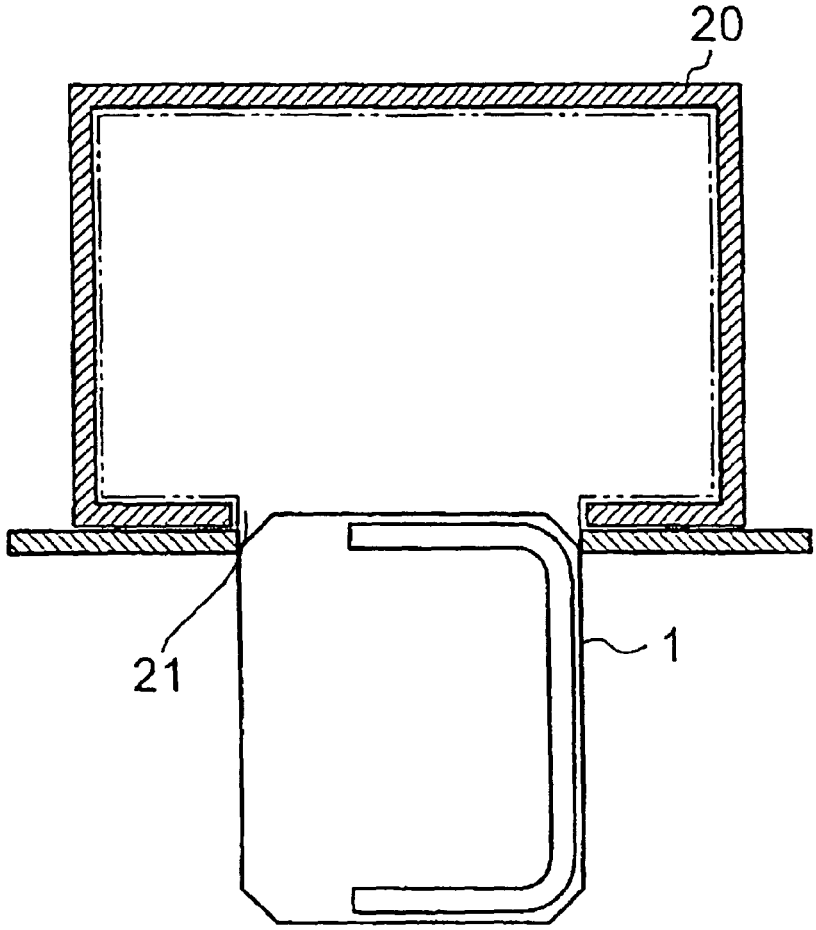
FIG. 6 is an explanatory view of operation, according to the first embodiment.

Next, operation for turning the outdoor unit satisfying the above-described conditions in the elevator cage 20 and conveying the same is explained. As shown in FIG. 6, the outdoor unit is moved toward the doorway of the elevator cage 20 first. Usually, the outdoor unit is conveyed by mounting it on a hand truck for conveyance, having universal casters, which is smaller than the outer peripheral face of the outdoor unit.

Figure 7:
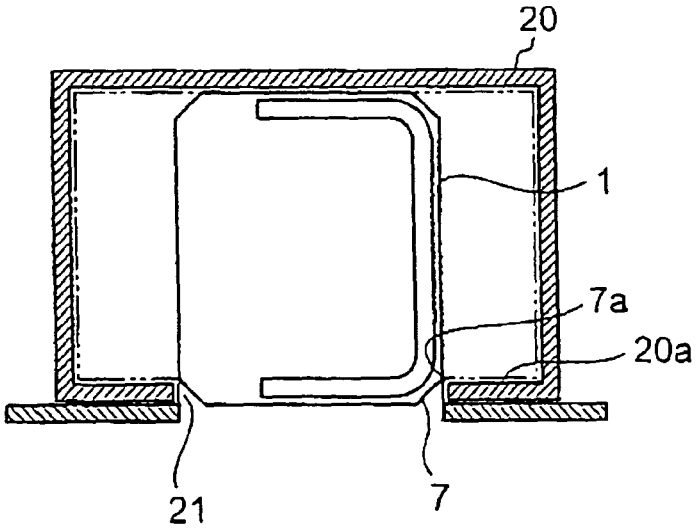
FIG. 7 is an explanatory view of operation, according to the first embodiment.
Figure 8:
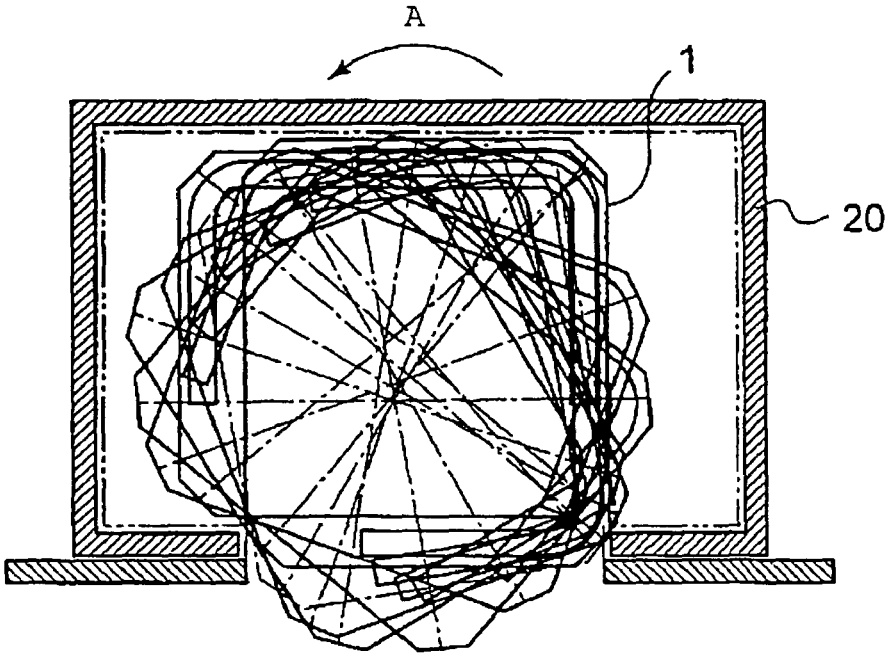
FIG. 8 is an explanatory view of operation, according to the first embodiment.

Then, as shown in FIG. 7, the outdoor unit is carried into the elevator cage 20 straight from the doorway 21 of the elevator cage 20. At this moment, since the width B between the side-faces of the outdoor unit is equal to the chamfered dimension added to the effective depth b of the elevator basket 20, i.e., b+X, the side face of one side of the outdoor unit is protruded from the elevator cage 20. However, an inside edge line 7*a* of the chamfered portion 7 of the outdoor unit is positioned at a portion inner than an internal wall 20*a* of the doorway 21 of the elevator cage 20 by 10 mm as a guarding thickness for the elevator cage 20. Next, as shown in FIG. 8, when the outdoor unit is turned in a direction indicated by an arrow A, it turns without interference of the chamfered portion 7 of the outdoor unit on a front side of the doorway 21 of the elevator cage 20 and on a rear side, and a part of the outdoor unit protruding from the elevator cage can be contained in the elevator cage 20. Thus, the outdoor unit is turned by 90 degrees in the direction A.

Figure 9:
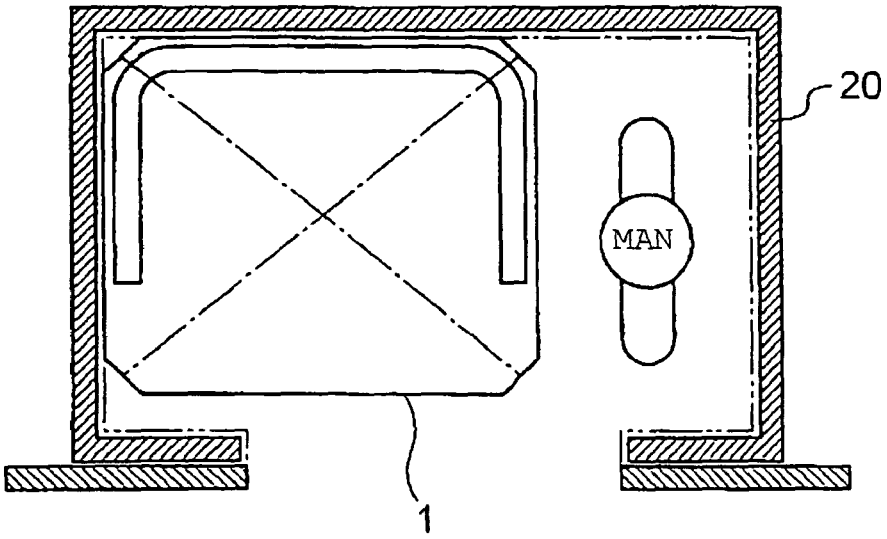
FIG. 9 is an explanatory view of operation, according to the first embodiment.

Next, as shown in FIG. 9, the outdoor unit after being turned is moved to one side of the elevator cage 20. When moving in a manner described above, a man who carries the outdoor unit can also ride in a space opposite to the outdoor unit.

According to the first embodiment, because the outdoor unit is enabled to be carried into and out from the elevator cage 20, while turning in the elevator cage 20 by chamfering an interfering portion of the outdoor unit, for example, even the 10-horsepower class outdoor unit is brought to be able to be conveyed by the existing elevator cage for general passenger use with a capacity of six passengers without using the crane or the like, and the worker can convey the outdoor unit while riding the elevator cage 20 therewith at this moment. As describe above, since the outdoor unit is brought to be able to be conveyed to the roof top or the like by means of existing facilities, a conveying cost can be reduced by achieving saving of labor at the time of conveyance, and the delivery period for installation of the outdoor unit can be reduced. Further, since the corner portion of the outdoor unit is chamfered, a wide opening portion is obtained, so that the conveyer can easily get in or out from the elevator cage 20 without being caught by the corner portion.

Incidentally, since the depth A of the outdoor unit is set to the effective dimension a of the doorway of the elevator cage 20, and the width B between the side-faces of the outdoor unit is set to the effective depth b of the elevator cage 20+chamfered dimension X, the conveyance performed using the elevator cage 20 is enabled even when the dimension of the outdoor unit in a width direction is increased by an extent of the chamfered dimension X at the corner part of the outdoor unit. Thus, even in a case of product having a large capacity, it can be conveyed by the elevator cage 20 when the above-mentioned condition is satisfied. That is, although the products larger than the depth of the elevator cage 20 and the doorway 21 cannot be conveyed in the past, the outdoor unit can be conveyed by the elevator cage 20 by means of forming the chamfered corner portion 7, even in a case of the outdoor unit of the 10-horsepower class.

Second Embodiment

Although the chamfered portion 7 of the outdoor unit is formed to have an angle of approximately 45 degrees in relation to the adjoining face of the housing in the first embodiment, further to the above, an auxiliary chamfered portion (not shown) having an angle of 45 degrees relative to the chamfered portion 7 is provided at standing edge portions, 7*a* and 7*b*, at both sides of the chamfered portion 7 in the second embodiment. By thus constructing, the turn of the outdoor unit in the elevator cage 20 at time of conveyance becomes easier.

Other construction, operation, and advantages are substantially the same as that of the case described in the first embodiment, and the explanation thereof is therefore omitted.

Third Embodiment

Although the chamfered portion 7 of the outdoor unit is formed to have an angle of approximately 45 degrees in relation to the adjoining face of the housing in the first embodiment, the chamfered portion 7 is formed by rounding (not shown) in the second embodiment. By thus constructing, the turn of the outdoor unit in the elevator cage 20 at the time of conveyance becomes easier, and elasticity occurs in the turning characteristic.

Other construction, operation, and advantages are substantially the same as that of the case described in the first embodiment, and the explanation thereof is therefore omitted.

Further, although the chamfered dimension can be respectively set to different values, in that case, the outline dimension of the outdoor unit is limited by the minimum chamfered dimension. In other words, this is because the portion interferes with an internal surface of the elevator cage 20.

Fourth Embodiment

In the fourth embodiment, a hand truck that occupies an area, smaller than that of the bottom face of the outdoor unit (not shown), is detachably attached to a lower portion of the outdoor unit so as to smoothly turn the outdoor unit in the elevator cage 20 without interference, when turning. As a result, a high conveyance capability of the outdoor unit can further be achieved.

Other construction, operation, and advantages are substantially the same as that of the case described in the first embodiment, and the explanation thereof is therefore omitted.

Fifth Embodiment

In the fifth embodiment, a roller (not shown) is detachably attached to the chamfer portion 7, or the standing edge portions, 7*a* and 7*b*, at both sides of the chamfered portion 7 so that the outdoor unit is smoothly turned, even when the outdoor unit touches the internal wall of the elevator cage 20, during turning in the elevator basket 20. The roller can be detached after the turning operation.

Other construction, operation, and advantages are substantially the same as that of the case described in the first embodiment, and the explanation thereof is therefore omitted.

INDUSTRIAL APPLICABILITY

In the aforementioned explanation, a case that the present invention is applied to an outdoor unit of an air conditioner is illustrated. However, the present invention is not limited to that described above, and is able to be applied to other devices and facilities.

REFERENCE NUMERALS

1: housing
7: chamfered portion
7*a*: edge portion of the chamfered portion
7*b*: edge portion of the chamfered portion
20: elevator cage
A: depth of the housing (dimension of a first face of the housing)
B: width of the housing (dimension of a second face of the housing)
a: effective dimension of a doorway of an elevator cage
b: effective dimension of a depth of the elevator cage
X: length of the chamfering portion (chamfering dimension)

The invention claimed is:

1. An air-conditioner unit, capable of being conveyed by an elevator cage, having side faces comprising a first face with a dimension narrower than an effective doorway dimension of the elevator cage, and a second face with a dimension wider than an effective depth dimension of the elevator cage, wherein a corner portion between the first face and the second face is chamfered by a chamfered dimension which is larger than a value obtained by subtracting the effective depth dimension of the elevator cage from the dimension of the second face.

2. The air-conditioner unit according to claim 1, wherein the chamfered dimension is set within a range where the chamfered portion does not interfere with bent portions of a heat exchanger arranged in the air-conditioner unit.

3. The air-conditioner unit according to claim 1, wherein the chamfered dimension is uniform in an up and down direction.

4. The air-conditioner unit according to claim 1, wherein the corner portion is chamfered such that the chamfered portion is formed at an angle of approximately 45 degrees in relation to an adjoining side face.

5. The air-conditioner unit according to claim 1, wherein the elevator cage has an effective inside size with 1400 mm width and 850 mm depth, and an effective doorway dimension of 800 mm, the dimension of the first face is set to 780 mm or less, and the dimension of the second face is set to more than 830 mm.

6. The air-conditioner unit according to claim 5, wherein the dimension of the second face is set to 1000 mm or less.

7. A method of conveying an air-conditioner unit having a first side face with a width narrower than an effective doorway dimension of an elevator cage, and a second side face with a width wider than an effective depth dimension of the elevator cage, comprising the steps of:

inserting the air-conditioner unit, whose corner portion between the first side face and the second side face is chamfered with a dimension larger than a value obtained by subtracting the effective depth of the elevator cage from the width of the second face, into the elevator cage from the doorway of the elevator cage; and carrying the air-conditioner unit into the elevator cage by turning the air-conditioner unit when an edge portion on second face side of the chamfered portion, which is formed between the first side face and the second side face and protrudes from the doorway of the elevator cage, is positioned inside the elevator cage.

* * * * *